US007392556B2

(12) United States Patent
Breneman

(10) Patent No.: US 7,392,556 B2
(45) Date of Patent: Jul. 1, 2008

(54) WIDE HEAD BEDDING AND METHOD FOR MAKING A BED FITTED WITH WIDE HEAD BEDDING

(76) Inventor: Richard Fred Breneman, P.O. Box 591, San Bruno, CA (US) 94066

( * ) Notice: Subject to any disclaimer, the term of this patent is extended or adjusted under 35 U.S.C. 154(b) by 0 days.

(21) Appl. No.: 11/522,125

(22) Filed: Sep. 15, 2006

(65) Prior Publication Data

US 2007/0061970 A1 Mar. 22, 2007

Related U.S. Application Data

(60) Provisional application No. 60/717,606, filed on Sep. 17, 2005.

(51) Int. Cl.
*A47G 9/02* (2006.01)

(52) U.S. Cl. ..... 5/482; 5/486; 5/496; 5/497

(58) Field of Classification Search ..... 5/482, 5/486, 495–497, 902
See application file for complete search history.

(56) References Cited

U.S. PATENT DOCUMENTS

| | | | |
|---|---|---|---|
| 2,689,961 | A | 9/1954 | Lieberthal |
| 3,072,776 | A | 1/1963 | Quenneville |
| 3,273,176 | A | 9/1966 | Millar |
| 3,508,285 | A | 4/1970 | Marquette |
| 3,962,739 | A | 6/1976 | Crockett |
| 4,266,308 | A | 5/1981 | Shatz |
| 4,402,098 | A | 9/1983 | McClam |
| 4,546,508 | A | 10/1985 | Ison |
| 4,964,184 | A | 10/1990 | Lewis |
| 5,901,389 | A | 5/1999 | Manner |
| 6,049,925 | A | 4/2000 | Lewis |

*Primary Examiner*—Michael Trettel
(74) *Attorney, Agent, or Firm*—Sharon J. Adams; Adams Law Office

(57) ABSTRACT

The invention is bedding for covering one or more persons in bed, with extra fabric at the head end of the bed to prevent drafts and to facilitate tucking bedding around bed occupant(s). The wide head bedding has a top edge, a foot edge, two side edges and at least one obtuse angle connecting the foot edge to at least one side edge so that the top of the bedding is wider than the bottom. In addition, the invention includes methods of making a bed with wide head bedding to preserve the aesthetic appearance of the bed.

18 Claims, 7 Drawing Sheets

20
24
26
10
22
12

28
52
36
32
48
34
16

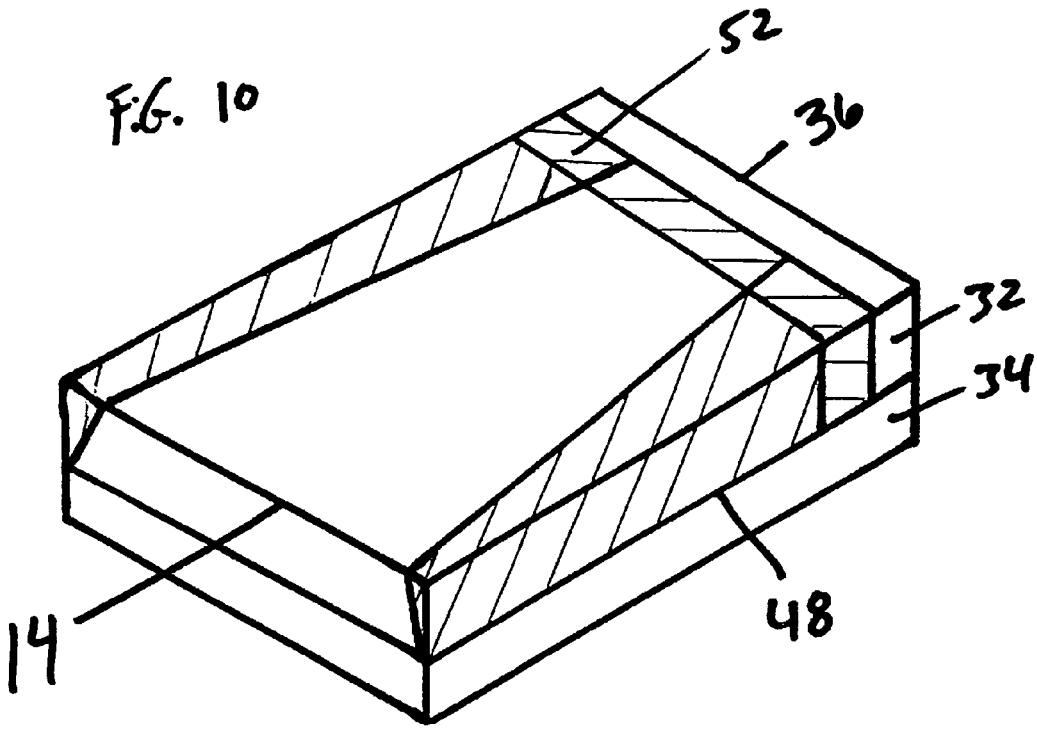
F.G. 10
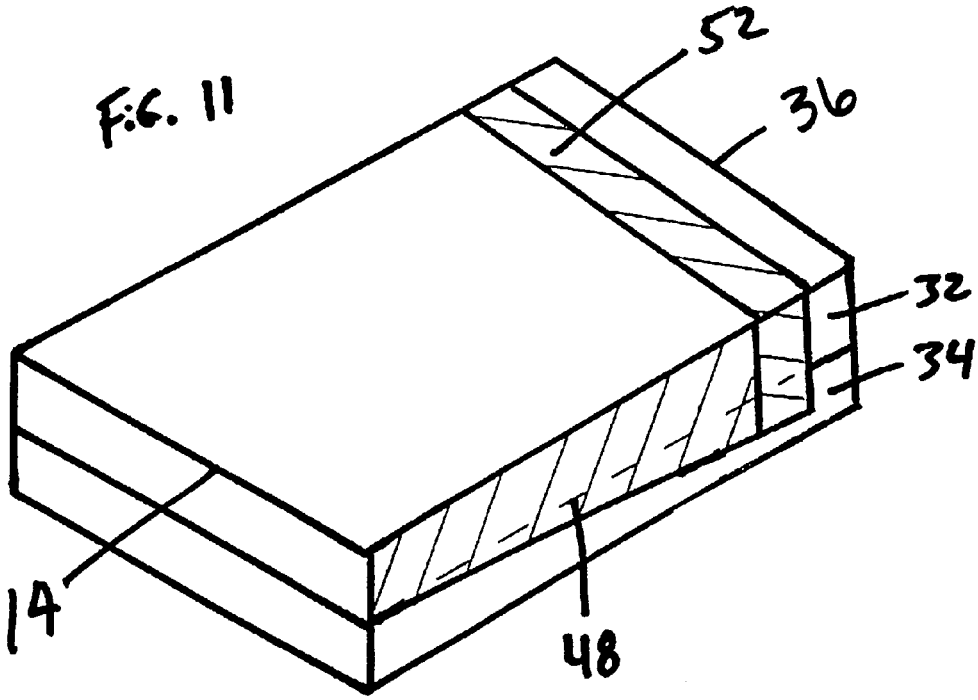
F.G. 11

WIDE HEAD BEDDING AND METHOD FOR MAKING A BED FITTED WITH WIDE HEAD BEDDING

CROSS REFERENCE TO RELATED APPLICATION

This application claims priority to U.S. Provisional Patent Application 60/17,606, filed Sep. 17, 2005, and is herein incorporated by reference in its entirety.

BACKGROUND OF THE INVENTION

This invention relates to bedding articles. Specifically to blankets, sheets, comforters, spreads, bed coverings and the method of making a bed using these articles.

There are many bedding articles on the market and in use in households and institutions all over the world, including sheets, blankets, comforters and spreads. These articles are made by many different manufacturers and of many different materials. They typically come in standard sizes to fit standard mattresses. They all serve the same basic purpose, to provide a layer of material for covering a person or persons in bed.

One very common likeness of these bedding articles is that they are rectangular in shape, with the head end and the foot end of the bedding articles having the same width. When people sleep or lie in bed there is a strong tendency to move around and cause openings between the bed coverings and mattress allowing cold air or drafts on the bed occupant(s). In addition, the bed occupant(s) may wish to tuck the bed coverings under one or both sides of the upper body. However, standard rectangular bed coverings typically do not provide sufficient material for bed occupant(s) to adequately prevent drafts. The present invention provides for extra material at and near the head end of the bed so that a person or persons in bed will be able to use that extra material to cover themselves, to prevent drafts, or to tuck under or around their body.

BRIEF SUMMARY OF THE INVENTION

The present invention relates to wide head bedding and methods for making a bed using the wide head bedding. The wide head bedding may include, either singularly or in any combination, sheets, blankets, comforters or spreads. All wide head bedding articles are not rectangular, but instead are wider at the head end than the foot end and contain at least one obtuse angle between the foot edge and one side edge of the wide head bedding. The side edges of the wide head bedding can be any shape that connects the narrower foot end to the wider head end of the bedding. The inventor currently prefers using either a straight or curved edge to connect the foot and head ends. However, any shape edge or combination of straight lines and curves may be used.

The invention also includes methods of making a bed using wide head bedding.

The wide head bedding is preferably sized to fit standard mattress sizes, including twin, double, queen, king and California king. However, the wide head bedding may be made to accommodate any size mattress.

BRIEF DESCRIPTION OF THE SEVERAL VIEWS

FIG. 10 is a top, perspective view of the second embodiment showing how the wide head bedding is placed on a bed.

FIG. 11 is a top, perspective view of the first embodiment showing how the wide head bedding is placed on a bed.

DETAILED DESCRIPTION OF THE INVENTION

Figure 1:
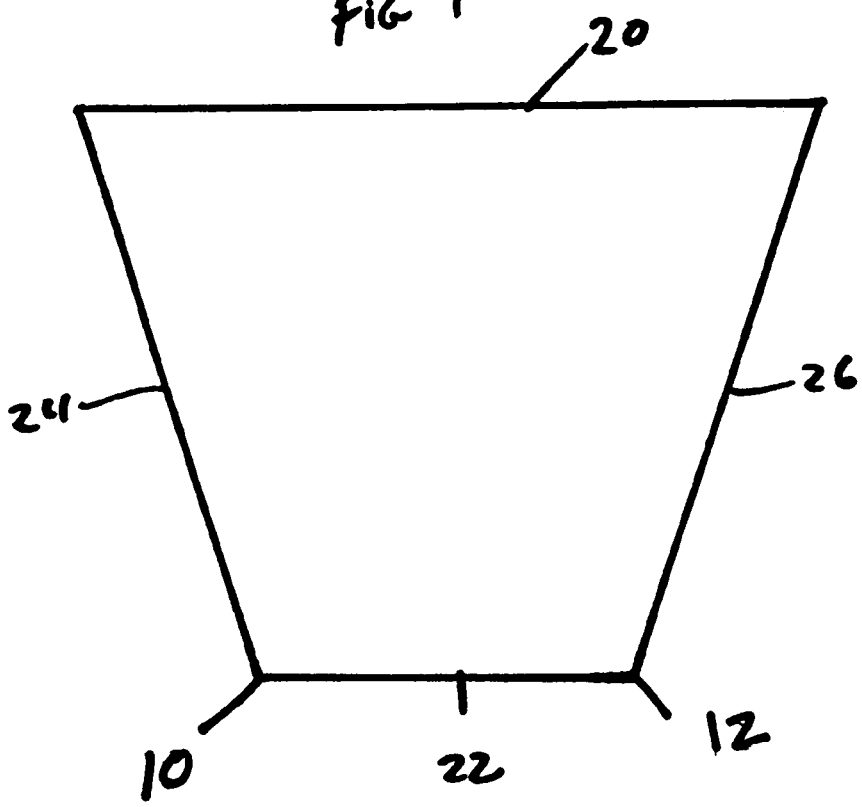
FIG. 1 is a top view of one embodiment of wide head bedding.

Bed coverings such as sheets, blankets, comforters or spreads are normally made in a rectangular shape that corresponds to the shape of a typical rectangular mattress. These traditional, rectangular bed coverings may cause struggle between bed occupants due to a lack of sufficient material to adequately cover all occupants to prevent drafts. Likewise, a single bed occupant may be subject to drafts due to movement of the bed coverings.

The present invention provides more material at the head end of the bed, to more fully cover the person or persons in bed, and to allow the bed occupant(s) to tuck material under one or both sides of their body to provide better coverage while in bed. Even if not tucked under the body the additional material of the wide head bedding reduces or eliminates drafts caused by openings between the bed coverings and the mattress. The wide head bedding is narrower at the foot end of the bed, eliminating excess material where it is not needed.

The wide head bedding may be sheets, blankets, comforters, spreads or any combination of these articles. Each of these articles will have a top surface and a bottom surface, a head edge 20, a foot edge 22, and two side edges (24 and 26) where each side edge connects head edge 20 to foot edge 22.

For each wide head bedding article head edge 20 has a greater length and thus is wider than foot edge 22. This will be accomplished by having at least one side edge (24 or 26) connecting foot edge 22 to head edge 20 through an obtuse angle (10 or 12). It is readily apparent that both side edges may connect the foot edge to the head edge through obtuse angles.

The side edges may be straight, a smooth curve, or any combination of straight lines, curves or multiple straight lines and curves, so long as the side edges connect a wider head edge to a narrower foot edge.

Head edge 20 of the wide head bedding may be of any size as long as it is wider than foot edge 22. The foot edge 22 of the bedding may be of any size as long as it is narrower than the head edge, and preferably is slightly wider than the foot end of mattress 32, including the mattress sides, so that foot edge 22 may be tucked under the mattress into space 48.

The wide head bedding may come in any combination of bedding articles. The wide head bedding flat sheet 52, commonly referred to as a top sheet, may be paired with a standard, rectangular fitted sheet, or may be a separate article. The wide head bedding articles may include, either singly or in combination, sheets, blankets, comforters, and spreads.

Figure 12:
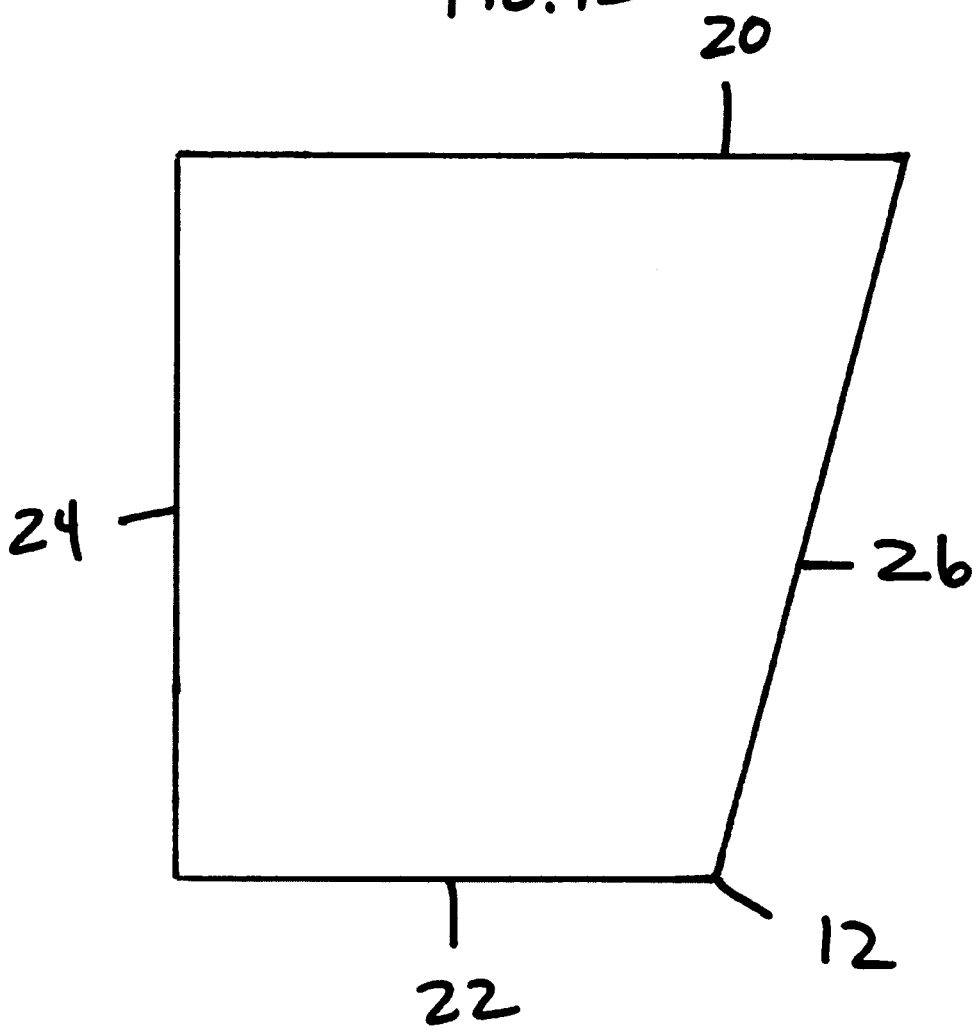
FIG. 12 is a top view of another embodiment of the wide head bedding.

The inventor currently prefers to manufacture the bedding from a roll of material that is approximately 10 feet wide to eliminate any seams in the bedding, however any width of material may be used. In the preferred embodiment both angles 10 and 12 attaching foot edge 22 to each side edge 24 and 26 will be obtuse and equal, as shown in FIG. 1. However, it is not necessary that both foot to side angles be obtuse, as shown in FIG. 12, as long as at least one angle is obtuse and the other angle is a right angle.

The bedding may be manufactured using any size of material, and may be formed by sewing, thermal bonding, gluing, or otherwise attaching two or more pieces of material together in such a manner that the wider head edge 20 is connected to the narrower foot edge 22 through two sides edges 24 and 26 where there is at least one obtuse angle 10 or 12 between at least one side edge and foot edge 22.

The wide head bedding articles may be manufactured from either woven or non-woven material, or any combination of woven and non-woven materials. The wide head bedding materials may be man-made, synthetic, natural, organic or any other material that is soft and flexible enough to comfortably cover a person or persons.

FIG. 1 illustrates one embodiment of any article of wide head bedding, including sheets, blankets, comforters and spreads, where the head edge 20 is wider than foot edge 22 and connected by side edges 24 and 26. Angles 10 and 12 are both obtuse and equal, creating a bilaterally symmetrical article of wide head bedding.

Figure 2:
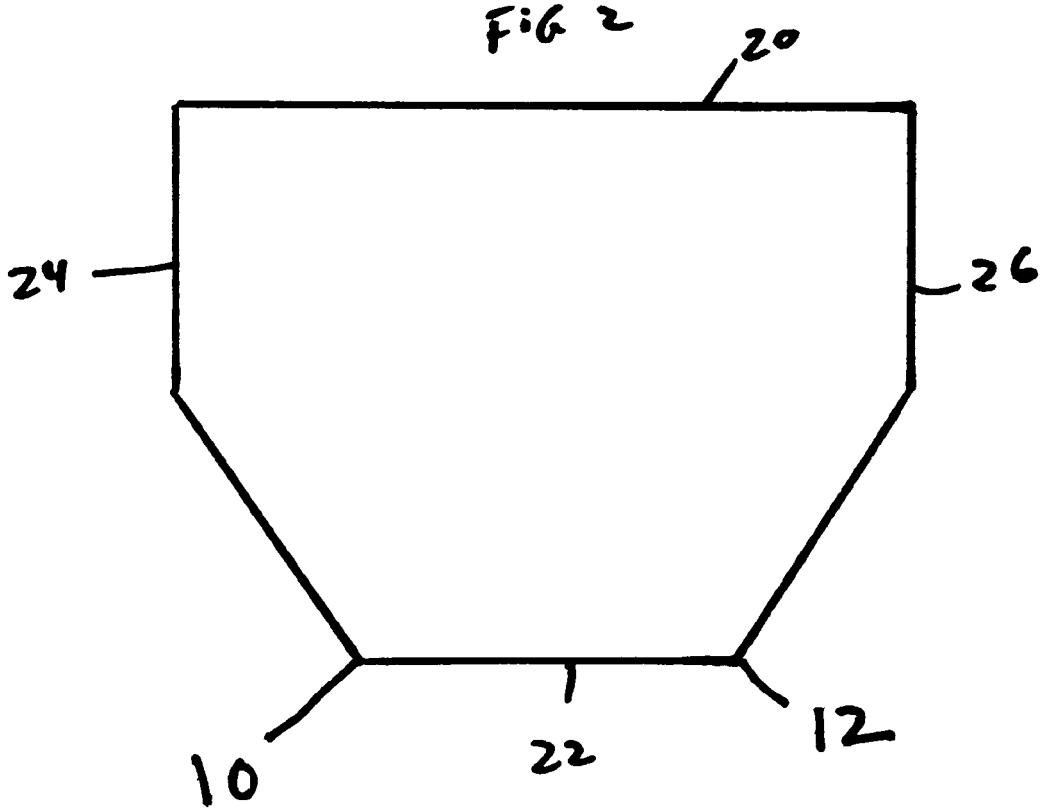
FIG. 2 is a top view of another embodiment of wide head bedding.

FIG. 2 illustrates another embodiment of any article of wide head bedding where the side edges 24 and 26 have a combination of straight lines connecting narrow foot edge 22 to wider head edge 20 through obtuse angles 10 and 12.

Figure 3:
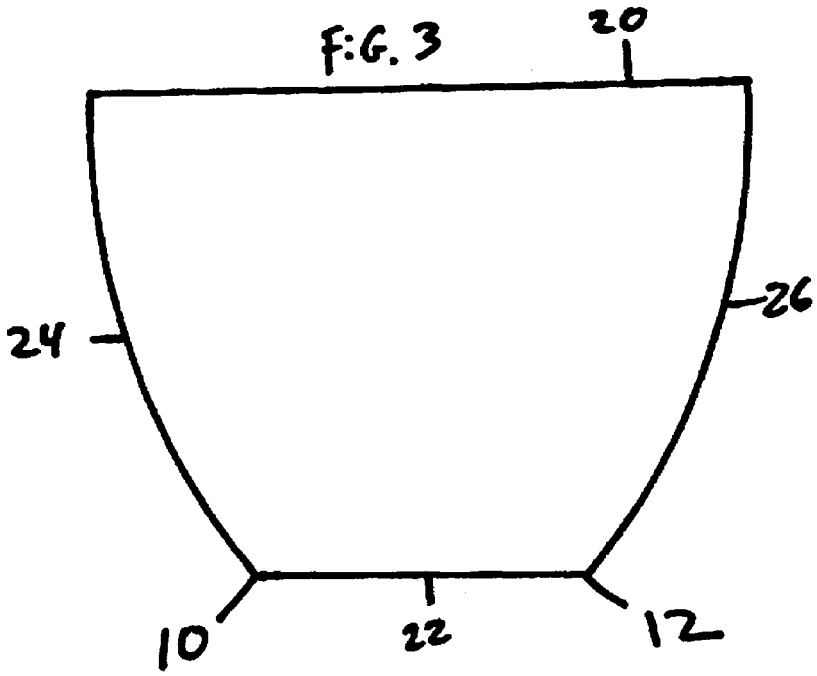
FIG. 3 is a top view of another embodiment of wide head bedding.

FIG. 3 illustrates another embodiment of any article of wide head bedding where side edges 24 and 26 connect narrow foot edge 22 to wider head edge 20 through obtuse angles 10 and 12, and where the side edges 24 and 26 are a continuous curve. It is apparent that many different combinations of straight and curved lines may be used for side edges 24 and 26, and that side edges 24 and 26 do not have to be identical, as long as the angle between foot edge 22 and at least one side edge is an obtuse angle.

Because of the extra fabric and width at the head of the wide head bedding, it may be desirable to make the bed in a manner that does not leave bedding articles trailing on the floor, or hanging in an unsightly manner. In addition, the bed is preferably made in such a manner as to allow the bed occupant easy access to the extra material provided by the wide head bedding. Thus, the bed is preferably not made by simply tucking all of the extra fabric at the head end under the mattress.

Figure 4:
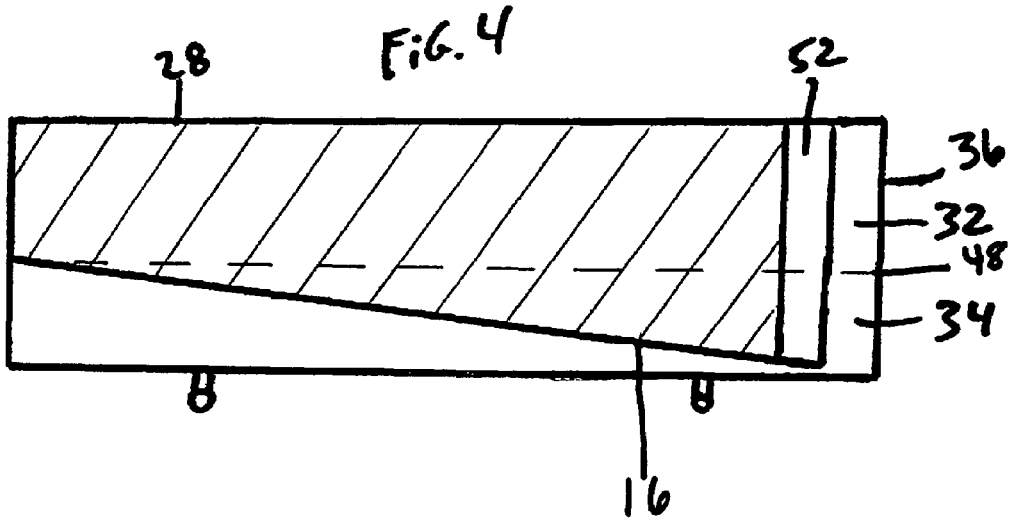
FIG. 4 is a side view of a first embodiment showing how the wide head bedding is placed on a bed.
Figure 6:
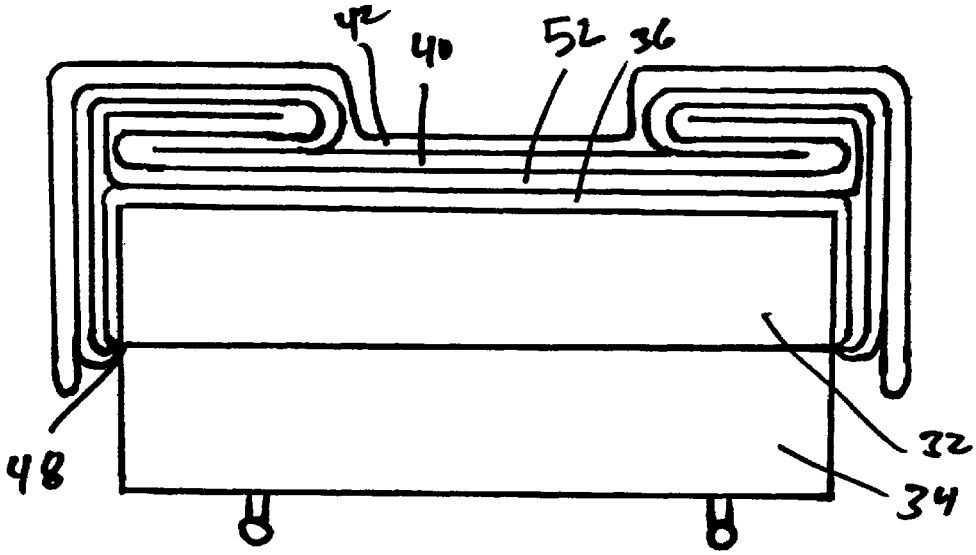
FIG. 6 is an end view of a second embodiment showing how the wide head bedding is placed on a bed.
Figure 5:
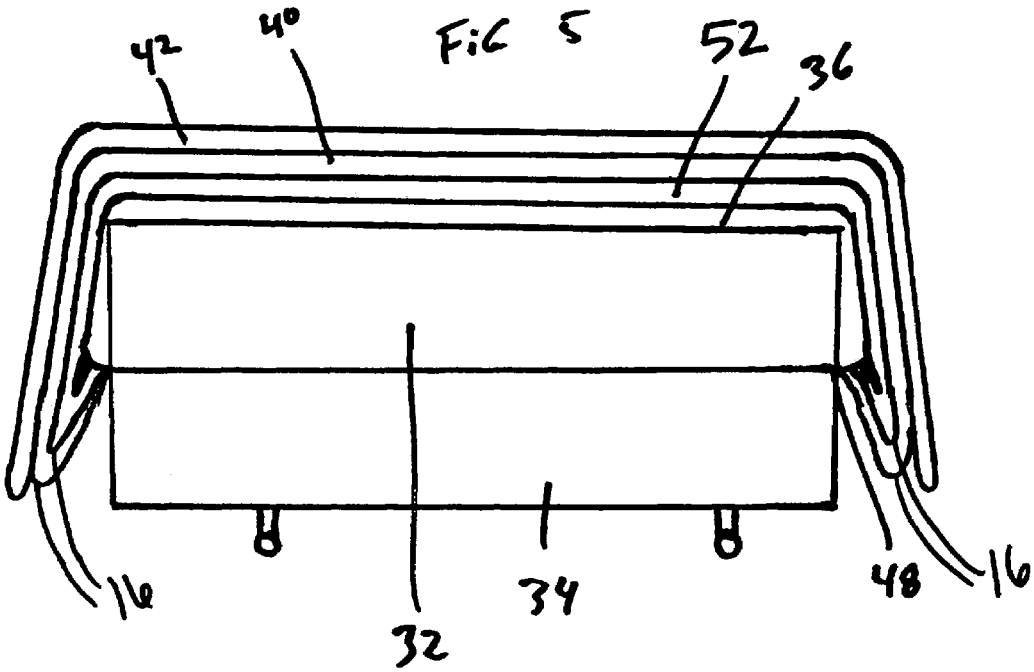
FIG. 5 is an end view of the first embodiment showing how the wide head bedding is placed on a bed.

One method for placing each bedding article, and the combination of bedding articles, is shown in FIGS. 4, 5 and 11. The fitted sheet 36 is placed on the bed in the standard manner. The wide head top sheet 52 is placed over the standard fitted sheet 36 so that the center point of the foot edge is essentially centered 14 with the foot of mattress 32. Sheet 52 is smoothed over mattress 32 so that head edge 20 is at or near the head of the bed, while a portion the bottom surface of sheet 52 that is equivalent to the top surface of mattress 32 is flat and facing toward the top of mattress 32. The remaining portion of sheet 52 is draped over the sides of mattress 32. This results in a greater amount of material at the head end of wide head sheet 52 draped over the sides of mattress 32 and hanging down below space 48. Side edges 24 and 26 of wide head top sheet 52 are tucked in space 48 between mattress 32 and box spring, bottom mattress, or other supporting structure 34. The amount of material tucked in may be varied depending on how much material is needed at the head end of the bed. However, in general, the amount tucked under mattress 32 and into space 48 will be the same along the length of each side edge 24 and 26 of wide head sheet 52, while leaving enough material to create fold 16.

Tucking in side edges 24 and 26 will result in fold 16. Fold 16 extends along the length of the bed in a line that is diagonal relative to space 48, and extends from below space 48 at the head of mattress 32 until it is even with space 48 at the foot end of mattress 32, as shown in FIG. 4. This method of making a bed using the wide head bedding provides easy access to the extra material when a person gets in the bed.

These same steps are repeated with any other wide head bedding article used. As shown in FIG. 5, wide head blanket 40 is centered over mattress 32 and on top of wide head sheet 52. An approximately equal amount of the length of side edges 24 and 26 of wide head blanket 40 are tucked in the space 48 between mattress 32 and supporting structure 34, again resulting in extra material at the head end of the bed, so that bed occupant(s) may have easy access to extra material to prevent drafts. In general, the amount of extra fabric hanging below space 48 will be approximately equal, as shown in FIG. 5. If desired, wide head sheet 52 may be turned back to cover the top edge of the other bedding, as shown in FIG. 11.

A standard bedspread 42 may be used, as shown in FIG. 5, or if desired, a wide head spread or comforter may be used and placed on the bed in the manner described above.

Another method for making a bed with wide head bedding is shown in FIGS. 6, 8, 9 and 10. In this method the extra material is placed on top of the bed, rather than hanging over the sides of mattress 32. Wide head top sheet 52 is placed over the standard fitted sheet 36 so that the center point of the foot edge 14 is essentially centered 14 with the foot of mattress 32, and the head edge 20 is at or near the head of the bed. Sheet 52 is smoothed over mattress 32 so that head edge 20 is at or near the head of the bed, while a portion the bottom surface of sheet 52 that is equivalent to the top surface of mattress 32 is flat and facing toward the top of mattress 32. The remaining portion of sheet 52 is draped over the sides of mattress 32. This results in a greater amount of material at the head end of wide head sheet 52 draped over the sides of mattress 32 and hanging down below space 48.

Side edges 24 and 26 of wide head top sheet 52 are tucked in space 48 between mattress 32 and box spring, bottom mattress, or other supporting structure 34. An even amount of the length of side edges 24 and 26 of wide head top sheet 52 are tucked in space 48 between mattress 32 and supporting structure 34. The amount of material tucked in may be varied depending on how much fabric is needed at the head end of the bed. However, in general, the amount tucked under mattress 32 will be the same along the length of each side edge of wide head sheet 52.

Figure 9:
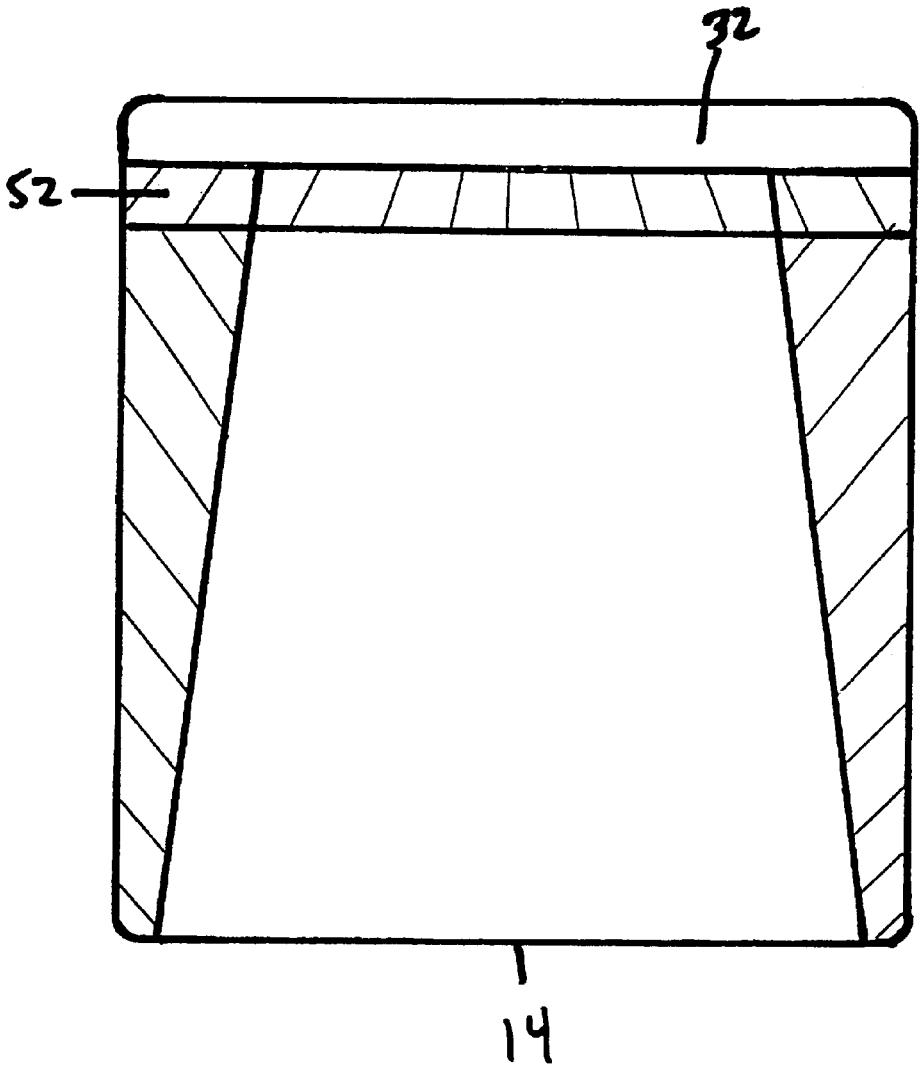
FIG. 9 is a top view of the second embodiment showing how the wide head bedding is placed on a bed.

In this embodiment the extra material is not allowed to hang below space 48. Instead, the bedding is pulled up from space 48 and folded over the top of the mattress at the junction of the top surface and sides of the mattress. Next, the excess material is folded again so that at the head end of the mattress the second fold is at or near the mattress edge. The material is smoothed over the top of mattress 32, creating a diagonal triple layer of material running the length of the bed. This results in a wider amount of material smoothed on top of mattress 32 near the head end of the bed than at the foot end of the bed, as shown in FIGS. 9 and 10.

These same steps are repeated with wide head blanket 40, comforter or spread, if desired. A wide head spread, or a standard bedspread 42, may be used to cover the bed.

Figure 7:
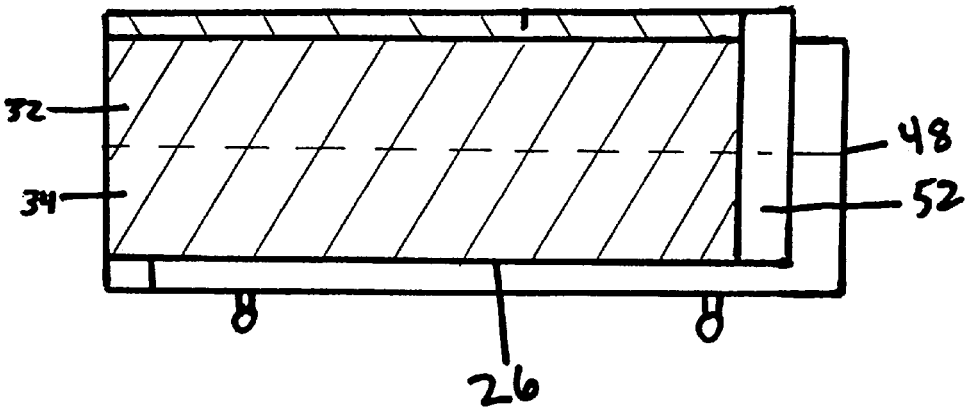
FIG. 7 is a side view of a third embodiment showing how the wide head bedding is placed on a bed.
Figure 8:
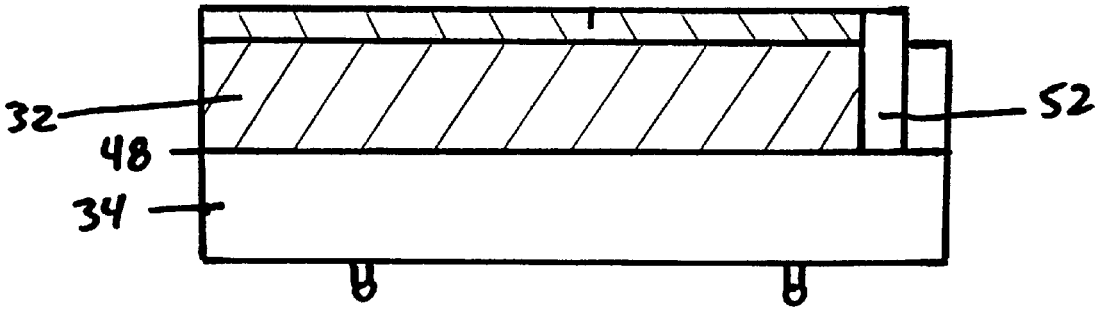
FIG. 8 is a side view of the second embodiment showing how the wide head bedding is placed on a bed.

FIG. 7 shows yet another method of making a bed using the wide head bedding. In this embodiment, side edges 24 and 26 are not tucked into space 48. Instead, side edges 24 and 26 are allowed to hang parallel to the floor and mattress 32, without being tucked in. The extra material is gathered, placed, and smoothed on top of mattress 32, as described above, again resulting is a greater amount of material at and near the head end of mattress 32, as shown in FIG. 9.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A covering for a bed comprising a flat, non-rectangular material shaped to have a head edge, a foot edge, a first side edge, a second side edge, an obtuse first angle connecting the foot edge to the first side edge, and an obtuse second angle connecting the foot edge to the second side edge wherein the head edge is longer than the foot edge and wherein each side edge is a curved edge.

2. The bed covering of claim 1 wherein the flat material is selected from the group consisting of woven, non-woven, synthetic, natural, and organic materials.

3. The bed covering of claim 1 wherein the shape is made from a single piece of material.

4. The bed covering of claim 1 made from at least two pieces of material attached together for form the shape.

5. A covering for a bed comprising a flat, non-rectangular material shaped to have a head edge, a foot edge, a first side edge, a second side edge, an obtuse first angle connecting the foot edge to the first side edge, and an obtuse second angle connecting the foot edge to the second side edge wherein the head edge is longer than the foot edge and wherein each side edge is a combination of curved and straight edges.

6. The covering for a bed of claim 5, wherein the first side edge is a combination of at least two straight edges and the second side edge is a combination of at least two straight edges.

7. The bed covering of claim 5 wherein the flat material is selected from the group consisting of woven, non-woven, synthetic, natural, and organic materials.

8. The bed covering of-claim 5 wherein the shape is made from a single piece of material.

9. The bed covering of claim 5 made from at least two pieces of material attached together for form the shape.

10. A method of making a bed using wide head bedding article, where the wide head bedding article is comprised of a flat, non-rectangular material with a top surface, a bottom surface, a head edge, a foot edge, and two side edges, a first angle connecting the foot edge to a first side edge, and a second angle connecting the foot edge to a second side edge, wherein the head edge is longer than the foot edge, and the foot edge is connected to at least one side edge through an obtuse angle, comprising the steps of:

centering a first article of wide head bedding on a mattress with two sides, a bottom surface, a top surface, a head end and a foot end, so that a center point of the wide head bedding article is centered with a center point on the top surface of the mattress;

placing the head edge of the bedding article near the head end of the mattress;

smoothing the bedding article over the mattress so that a portion of the bottom surface of the bedding article equivalent to the top surface of the mattress is flat and facing toward the top surface of the mattress;

draping a remaining portion of the bedding article over the mattress sides so that some of the bedding article will hang below the bottom of the mattress;

tucking an even length of the first side edge into a space between the mattress and a supporting structure so that sufficient material remains to. create a fold hanging below the bottom of the mattress near the head of the mattress; and tucking an even length of the second side edge into a space between the mattress and the supporting structure so that sufficient material remains to create a fold hanging below the bottom of the mattress near the head of the mattress.

11. The method of claim 10 wherein the bedding article is selected from the group consisting of sheets, blankets, comforters and spreads.

12. The method of claim 10 wherein more than one wide head bedding article is placed on the bed using the steps of claim 10.

13. A method of making a bed using wide head bedding article, where the wide head bedding article is comprised of a flat, non-rectangular material with a top surface, a bottom surface, a head edge, a foot edge, and two side edges;a first angle connecting the foot edge to a first side edge, and a second angle connecting the foot edge to a second side edge, wherein the head edge is longer than the foot edge, and the foot edge is connected to at least one side edge through an obtuse angle, comprising the steps of:

centering a first article of wide head bedding on a mattress with two sides, a bottom surface, a top surface, a head end and a foot end, so that a center point of the wide head bedding article is centered with a center point on the top surface of the mattress;

placing the head edge of the bedding article near the head end of the mattress;

smoothing the bedding article over the mattress so that a portion of the bottom surface of the bedding article equivalent to the top surface of the mattress is flat and facing toward the top surface of the mattress;

draping a remaining portion of the bedding article over the mattress sides so that some of the bedding article will hang below the bottom of the mattress;

pulling the material hanging below the bottom of the mattress over the top surface of the mattress so that the bedding article does not hang below the bottom of the mattress;

folding the material at a junction between the top and each side of the mattress;

folding the material again to create a second fold where head edge of the article the second fold is near the junction between the top and each side of the mattress.

14. The method of claim 13 wherein the bedding article is selected from the group consisting of sheets, blankets, comforters and spreads.

15. The method of claim 13 wherein more than one wide head bedding article is placed on the bed using the steps of claim 13.

16. The method of claim 13 wherein after the bedding is draped over the sides of the mattress, included are additional steps of:

tucking an even length of the first side edge into a space between the mattress and a supporting structure so that sufficient material remains to create a fold hanging below the bottom of the mattress near the head of the mattress; and tucking an even length of the second side edge into a space between the mattress and the supporting structure so that sufficient material remains to create a fold hanging below the bottom of the mattress near the head of the mattress.

17. The method of claim 16 wherein the bedding article is selected from the group consisting of sheets, blankets, comforters and spreads.

18. The method of claim 16 wherein more than one wide head bedding article is placed on the bed using the steps of claim 16.

* * * * *